US006364940B1

(12) United States Patent
Prueter et al.

(10) Patent No.: US 6,364,940 B1
(45) Date of Patent: Apr. 2, 2002

(54) COMPACT, HIGH-EFFICIENCY, GAS/LIQUID SEPARATOR METHOD AND APPARATUS

(75) Inventors: William Paul Prueter, Alliance; Daniel Patrick Birmingham, North Canton; Matthew James Reed, Canton, all of OH (US)

(73) Assignee: McDermott Technology Inc., New Orleans, LA (US)

( * ) Notice: Subject to any disclaimer, the term of this patent is extended or adjusted under 35 U.S.C. 154(b) by 1338 days.

(21) Appl. No.: 08/695,947

(22) Filed: Aug. 13, 1996

Related U.S. Application Data

(63) Continuation of application No. 08/337,359, filed on Nov. 10, 1994, now abandoned.

(51) Int. Cl.[7] ..... B01D 19/00

(52) U.S. Cl. ..... 95/261; 55/345; 55/457; 95/248; 96/208; 96/216

(58) Field of Search ..... 95/261, 248; 96/208, 96/216; 55/345, 457

(56) References Cited

U.S. PATENT DOCUMENTS

| | | | | |
|---|---|---|---|---|
| 791,517 A | 6/1905 | Walker | | |
| 2,004,468 A | 6/1935 | Hawley | 183/80 | |
| 2,037,426 A | 4/1936 | McKeever | 183/2.7 | |
| 2,256,524 A | 9/1941 | McKelvey | 183/2.7 | |
| 2,284,513 A | 5/1942 | Coward | 183/103 | |
| 2,533,977 A | 12/1950 | Van Dornick | 183/2.7 | |
| 2,792,075 A | 4/1957 | McBride et al. | 183/34 | |
| 2,862,479 A | 12/1958 | Blaser et al. | 122/34 | |
| 2,923,377 A | 2/1960 | Schluderberg | 183/85 | |
| 3,324,634 A | 6/1967 | Brahler et al. | 55/337 | |
| 3,345,046 A | 10/1967 | Versluys et al. | 261/79 | |
| 3,360,908 A | 1/1968 | Baily | 55/347 | |
| 3,488,927 A | 1/1970 | Jepsen et al. | 55/237 | |

(List continued on next page.)

FOREIGN PATENT DOCUMENTS

| | | | |
|---|---|---|---|
| CH | 420 061 | 9/1967 | |
| DE | 109 804 | 11/1974 | B01D/3/14 |
| EP | 0 048 508 | 3/1985 | B01D/45/12 |
| EP | 0 195 464 | 4/1989 | B01D/45/16 |
| GB | 2 051 181 | 10/1970 | F22B/37/32 |
| GB | 2124929 | * 2/1984 | 96/208 |
| GB | 02203062 | 10/1988 | B01D/19/00 |
| NO | 1123546 | 2/1965 | B01D/3/26 |

OTHER PUBLICATIONS

Prueter, Reed & Schneider, "Extended Steam/Water Testing of the Babcock & Wilcox Separation Equipment", B&W Technical Paper presented at the Second International Steam Generator & Heat Exchanger Conference, Toronto, CANADA, Jun. 13–15, 1994. Entire paper.

(List continued on next page.)

*Primary Examiner*—Krisanne Thornton
(74) *Attorney, Agent, or Firm*—Robert C. Baraona; Eric Marich

(57) ABSTRACT

A method and apparatus for separating a wellhead fluid mixture containing oil and gas phases obtained from hydrocarbon production systems into its constituent parts employs a pressure vessel having an inlet for entry of the wellhead fluids mixture and an outlet for exit of a separated gas referred to as export gas. A primary centrifugal separator is provided in the pressure vessel for centrifugally separating a first portion of the oil from the wellhead fluids mixture to produce a wet gas containing some remaining oil. A second centrifugal separator is also provided in the vessel and performs a second centrifugal separation operation on the wet gas to remove substantially all of the remaining oil from the wet gas to produce the export gas which is conveyed out of the pressure vessel. The oil and remaining oil separated from the wellhead fluids mixture is conveyed from the pressure vessel via another outlet.

8 Claims, 4 Drawing Sheets

U.S. PATENT DOCUMENTS

| | | | | | |
|---|---|---|---|---|---|
| 3,641,745 | A | * | 2/1972 | Moore | 55/345 |
| 3,654,748 | A | * | 4/1972 | Bloom | 55/345 X |
| 3,710,556 | A | | 1/1973 | Barratt et al. | 55/210 |
| 3,788,282 | A | | 1/1974 | Modrak et al. | 122/34 |
| 3,796,026 | A | | 3/1974 | Mugford | 55/338 |
| 3,961,923 | A | | 6/1976 | Zia Rouhani | 55/457 |
| 4,015,960 | A | | 4/1977 | Nutter | 55/355 |
| 4,077,362 | A | | 3/1978 | Hawkins | 122/491 |
| 4,238,210 | A | | 12/1980 | Ragehr et al. | 55/396 |
| 4,289,514 | A | | 9/1981 | Carter et al. | 55/398 |
| 4,349,360 | A | | 9/1982 | Schuurmans et al. | 55/238 |
| 4,358,301 | A | * | 11/1982 | Chaix et al. | 55/345 X |
| 4,629,481 | A | * | 12/1986 | Echols | 55/457 X |
| 4,648,890 | A | | 3/1987 | Kidwell et al. | 57/347 |
| 4,982,794 | A | | 1/1991 | Houot | 166/357 |
| 5,033,915 | A | | 7/1991 | Albrecht | 406/173 |
| 5,209,765 | A | * | 5/1993 | Kolpak et al. | 55/345 X |

OTHER PUBLICATIONS

Giset & Woulfe, "The Three Stroke Separation and Transportation System", Offshore Technology Conference [OTC] Paper #7039, Copyright 1992, Offshore Technology Conference. Paper presented at the 24th Annual OTC in Houston, Texas, May 4–7, 1992, pp. 503–508.

Brekke, "The Aker Three Stroke Separation—Transportation System", 1991 ICHEME—Subsea Separation and Transport III Conference in London, United Kingdom. Entire paper.

Edwards, W.G., "Boet Subsea Separation Development", 1991 ICHEME—Subsea Separation and Transport III Conference in London, United Kingdom. Entire paper.

Songhurst & Edwards, "Subsea Separation: An Economic Method for Submarginal Fields," OTC Paper #5922, Copyright 1989, Offshore Technology Conference. Paper presented at the 21th Annual OTC in Houston, Texas, May 1–4, 1989. pp. 405–416.

Baker & Entress, "The VASPS Subsea Separation and Pumping System", *Trans IChemE,* vol. 70, Part A, Jan. 1992. pp. 9–16.

Entress Baker Jardine & Assocs.; Pridden, Mentor Engineering Consultants; and Baker, Baker Jardine & Assocs., "The Current State of Development of the VASPS Subsea Separation and Pumping System", OTC PAper #6768, Copyright 1991, Offshore Technology Conference. Presented at 23rd Annual OTC in Houston, Texas, May 6–9, 1991. pp. 627–635.

Lovie, Bardex Subsea Corp.; Baugus, Oryx Energy Co.; Grecco, Unocal Corp.; and Schutter, Chevron Research & Technology Co., "Subsea Processing System Ready for Gulf of Mexico Field Conditions". OTC Paper #7245, Copyright 1993, Offshore Technology Conference. Presented at the 25th Annual OTC in Houston, Texas, May 3–6, 1993, pp. 393–404.

Sarshar, "Subsea Separation: Technology, Equipment Available Now", 1991 ICHEME—Subsea Separation and Transport III Conference in London, United Kingdom. Entire paper.

Queseth, Yardley & Stinessen, "A Feasible Way to Perform Subsea Separation and Gas Compression", PD–vol. 46, Pipeline Engineering '92, ASME 1992. pp. 51–61.

Queth & Stinessen, "Kværner Booster Station Development Project—Phase 2", ICHEME—Subsea Separation and Transport III Conference in London, United Kingdom. Entire Paper.

Beran, Brown & Root Seaflo; Hatton, Texaco, Inc.; Stires, BHP Petroleum (Americas) Inc.; and Gunderson, Exxon Production Research, "Subsea Pressure Boost/Separation—A Necessity for Deepwater Development?". OTC Paper #7267. Presented at the 25th Annual OTC in Houston, Texas, May 3–6, 1993. Entire paper.

Shoup, Amoco Production Co. & Shoham, U. of Tulsa, "Pipeline Design for Deepwater Gulf of Mexico Developments". OTC Paper #6411, Copyright 1990, Offshore Technology Conference. Paper presented at the 22nd Annual OTC in Houston, Texas, May 7–10, 1990, pp. 609–621.

Stinessen, Gustafson (Kvaerner Energy, Oslo, Norway) & Lunde (SINTEF, Trondheim, Norway), "Test Results from the Integration Testing of the Kvaerner Booster Station at the SINTEF Multiphase Flow Laboratory". Presented at the 6th International Conference on Multiphase Production, BHR Group Conference Series, Pub. 4, Cannes, France, Jun 1993. pp. 415–436.

Coker, A.K.C. Technology, Sutton Coldfield, U.K., "Computer program enhances guidelines for gas–liquid separator designs", *Oil and Gas Journal,* May 10, 1993. pp. 55–62.

Birmingham, D.P. & Davies, S.R. SPE 30401—"Evaluation of Compact Steam/Water Separation Equipment for Gas/Oil Systems". ©1995, Society of Petroleum Engineers, Inc. Presented at the Offshore Europe Conference in Aberdeen, Scotland, Sep. 5–8, 1995, pp. 351–368.

* cited by examiner

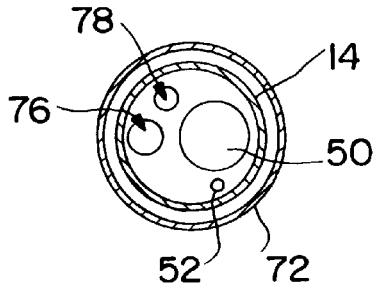
FIG. 4
FIG. 3
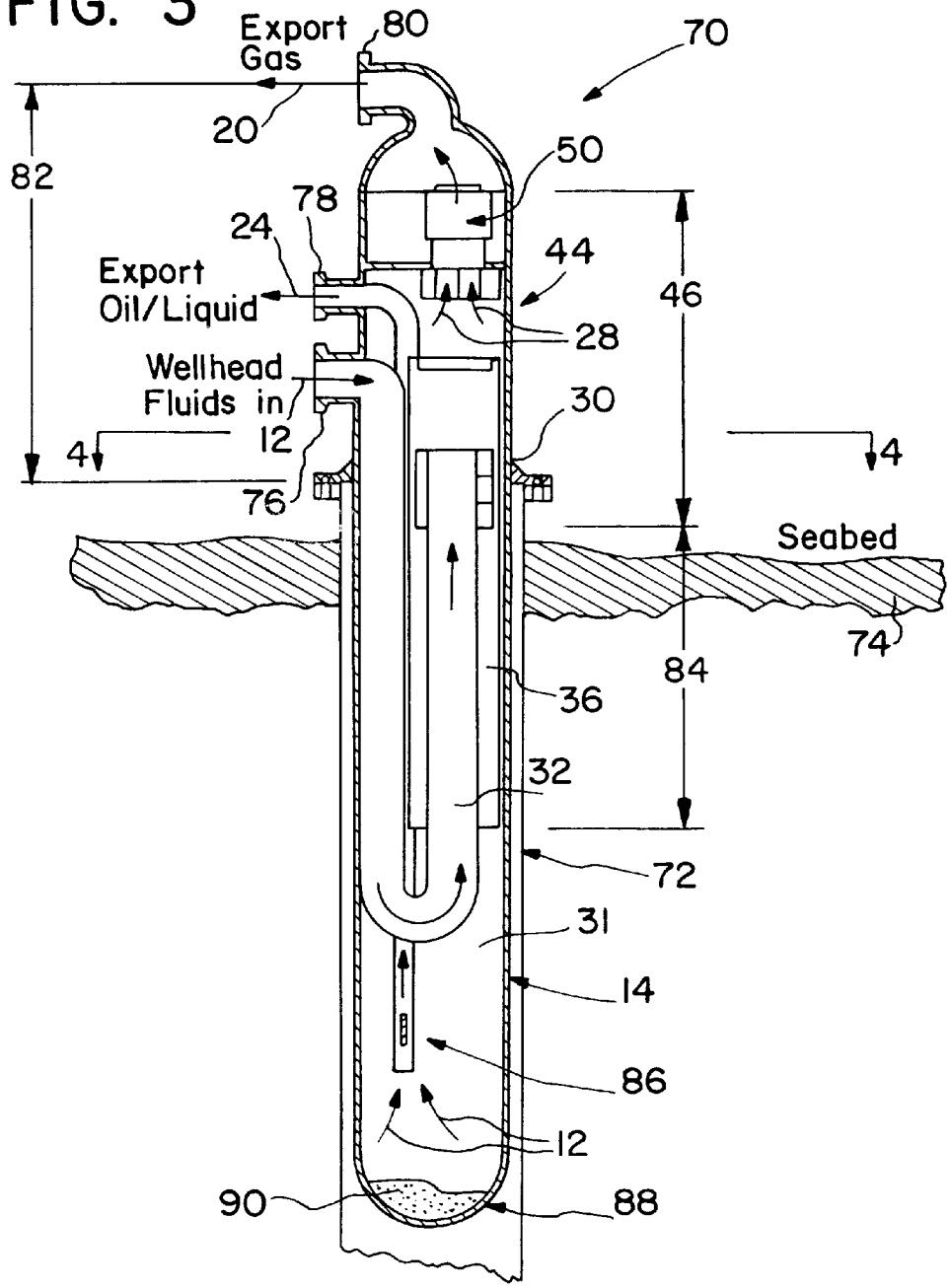

COMPACT, HIGH-EFFICIENCY, GAS/LIQUID SEPARATOR METHOD AND APPARATUS

This is a continuation of application Ser. No. 08/337,359 filed Nov. 10, 1994 now abandoned.

FIELD AND BACKGROUND OF THE INVENTION

The present invention relates in general, to separation systems and, in particular, to a new and useful method and apparatus for separating a multiple phase mixture into separate vapor and liquid phases utilizing single or multiple pairs of centrifugal force separators. The present invention is particularly suited for applications involving the separation of oil and gas phases contained in wellhead fluids obtained from hydrocarbon production systems. The present invention can be employed either topside or in subsea locations.

Most of the known gas/oil separation systems rely on natural or gravity separation which requires large vessels to achieve the desired separation performance. When natural separation is used in a relatively small vessel, the throughput or vapor flux of that system is significantly smaller when compared to other systems not relying on natural separation. An example of a system which apparently uses natural separation is described in U.S. Pat. No. 4,982,794.

One known separation system is disclosed in UK Patent Application No. GB 2 203 062 A and uses centrifugal separation for a primary separation stage and inertial separation (i.e., scrubbers) for a second stage of separation. Although this system most likely has higher separation capacities than a system relying on natural separation, it most likely has less capacity when compared to a system that could employ centrifugal separation for both stages.

Presently, there is no known gas/oil separation system or method for separating a multiple phase mixture of oil and gas into separate vapor and liquid phases utilizing single or multiple pairs of centrifugal force separators.

SUMMARY OF THE INVENTION

The present invention is drawn to a method and apparatus particularly suited for separating a wellhead fluid mixture containing oil and gas phases obtained from hydrocarbon production systems into its constituent parts. The present invention can be employed either topside or in subsea applications through the use of a compact and highly efficient separator arrangement.

More particularly, one aspect of the present invention is drawn to a separation apparatus which utilizes one or more curved-arm, centrifugal force, primary separator(s) and one or more cyclone, centrifugal force, secondary separator(s). Except for some changes made to the curved-arms, the primary separator is very similar to the separator described in U.S. Pat. No. 4,648,890 to Kidwell et al., assigned to The Babcock & Wilcox Company. The secondary separator is similar to the separator described in U.S. Pat. No. 3,324,634 to Brahler et al., also assigned to The Babcock & Wilcox Company. The primary and secondary separators are always employed in pairs, and the combination of a centrifugal-type primary and secondary separator as utilized by the present invention provides a compact and highly-efficient separator arrangement. The separator apparatus can be used in multiple pairs (two or more primary and two or more secondary separators) or in an apparatus having only a single primary and a single secondary separator. The multiple pair arrangement would be typically used for topside applications while the single primary/single secondary separator arrangement would typically be sufficient to satisfy most subsea applications.

Another aspect of the present invention is drawn to a method for separating a wellhead fluid mixture obtained from hydrocarbon production systems containing oil and gas phases into its constituent parts, using the broad concepts discussed above.

Currently, topside or platform separation is normally performed using gravity separation which requires very large drum or pressure vessel volumes. Not only is the present invention less costly to fabricate due to its smaller size than known separation devices, but the reduced size of the gas/oil separator of the present invention thus requires less platform space, an economically attractive feature since the cost of platforms is directly related to the size of the vessels.

The present invention also provides a unique and efficient compact apparatus for subsea separation of a gas and liquid mixture. In a subsea application, the present invention provides the most benefit for marginal field developments because without subsea separation, marginal fields may become economically unfeasible to operate.

As is well-known, subsea separation provides for the separation of vapor and liquid phases prior to transporting the fluids to a platform or production facility. Fewer technical challenges are involved with first separating the phases and then separately transporting them downstream as compared to transporting a multi-phase mixture of gas and oil where slugging and hydrate formation issues are prevalent.

Presently, no other apparatus is known which provides a combination of centrifugal force primary and secondary separators having the compactness and high capacity separation efficiency of the present invention.

The various features of novelty which characterize the invention are pointed out with particularity in the claims annexed to and forming a part of this disclosure. For a better understanding of the invention, its operating advantages and specific results attained by its uses, reference is made to the accompanying drawings and descriptive matter in which preferred embodiments of the invention are illustrated.

BRIEF DESCRIPTION OF THE DRAWINGS

In the drawings:

FIG. 3 is a schematic sectional view illustrating a second embodiment of the present invention utilizing a single primary and a single secondary centrifugal separators;

FIG. 4 is a cross-sectional view taken in the direction of arrows 4—4 of FIG. 3;

DESCRIPTION OF THE PREFERRED EMBODIMENTS

Figure 2:
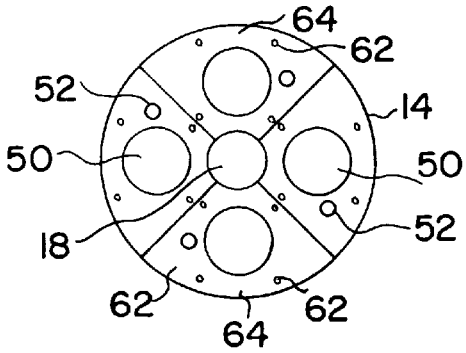
FIG. 2 is a cross-sectional view taken in the direction of arrows 2—2 of FIG. 1.
Figure 1:
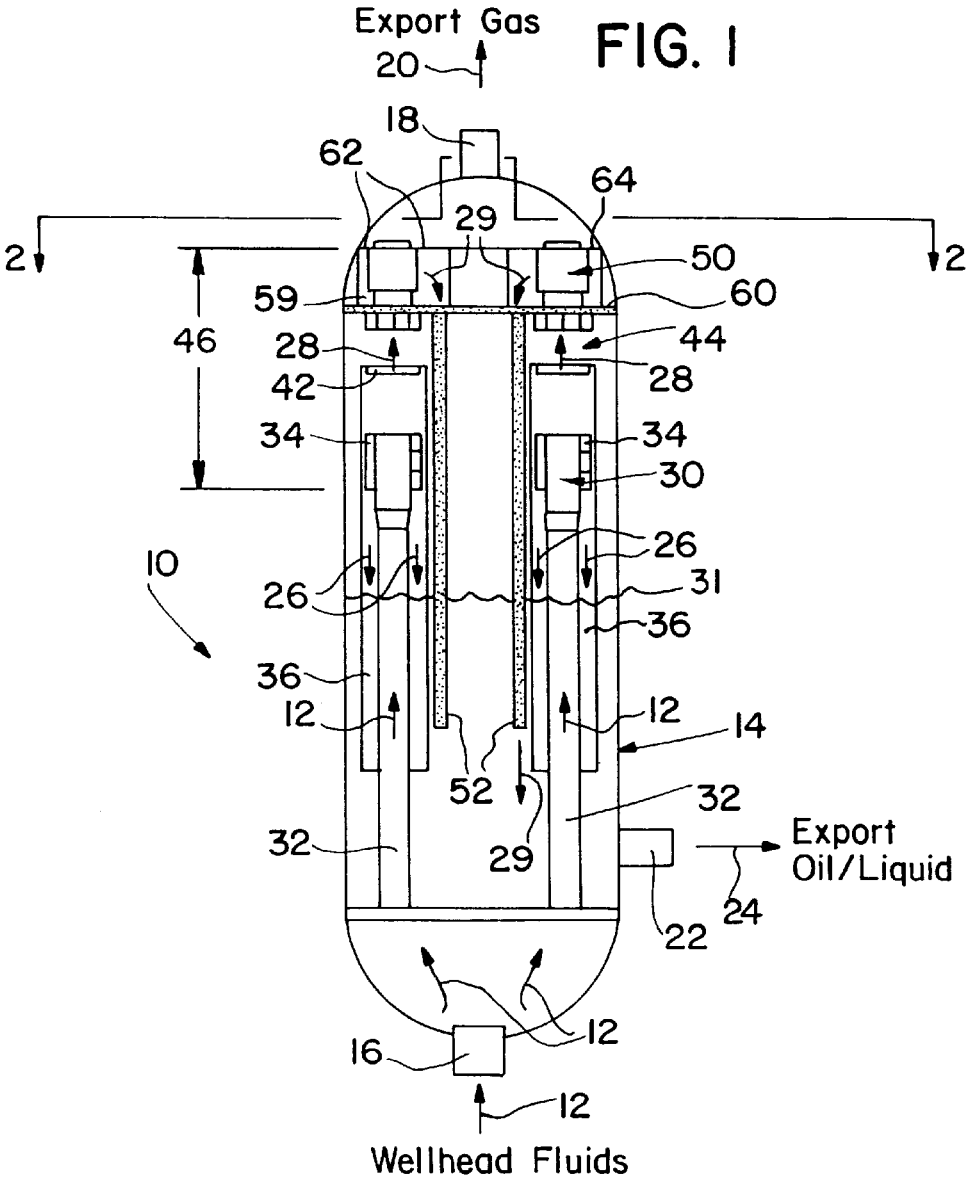
FIG. 1 is a schematic sectional view illustrating a first embodiment of the present invention utilizing plural primary and plural secondary centrifugal separators.

Referring to the drawings generally, wherein like numerals designate the same or functionally similar elements throughout the several drawings, and to FIG. 1 in particular, one aspect of the present invention is drawn to a compact, high-efficiency, multiple pair, centrifugal gas/oil separator apparatus, generally designated 10, for separating wellhead fluids 12 obtained from hydrocarbon production systems into separate oil and gas phases. As used herein, the term wellhead fluid means any two-phase mixture of oil and gas substantially in its natural state as extracted from the earth, or as transported from its extraction point to the gas/oil separator of the present invention.

The gas/oil separator 10 comprises a drum or pressure vessel 14 having a wellhead fluid inlet 16 for providing the wellhead fluids 12 (typically crude oil and entrained gases) into the pressure vessel 14. A gas export outlet 18 is located at an end opposite the fluid inlet 16 of pressure vessel 14 for conveying separated gases 20 from the pressure vessel 14. Pressure vessel 14 includes an oil/liquid export outlet 22 for conveying separated oil/liquids 24 from the pressure vessel 14. As shown in FIG. 1, pressure vessel 14 is oriented substantially vertically, with the wellhead fluid inlet 16 located generally at a lower end thereof, the gas export outlet 18 located at an upper end thereof, and the liquid export outlet 22 located at some intermediate location.

The oil/gas separator 10 employs multiple pairs of centrifugal force separators; in particular, one or more curved-arm, centrifugal force, primary separator(s) 30 and one or more cyclone, centrifugal force, secondary separator(s) 50. Since these primary and secondary separators 30, 50 are similar to those described in the aforementioned U.S. Pat. Nos. 4,648,890 and 3,324,634, the text of same is hereby incorporated by reference and the reader is referred to same as needed for specific details. The primary and secondary separators 30, 50 are always employed in pairs, and the combination of a centrifugal-type primary and secondary separator as utilized by the present invention provides a compact and highly-efficient separator arrangement. The wellhead fluids 12 are first acted upon by the curved-arm, centrifugal force, primary separator(s) 30 which perform a first centrifugal force separation of oil/liquids 26 from the two-phase wellhead fluids 12, producing a wet gas 28 with some remaining oil/liquid 29 therein. Then, the cyclone, centrifugal force, secondary separator(s) 50, located above and paired together with the curved-arm, centrifugal force, primary separator(s) 30, perform a second centrifugal force separation operation on the wet gas 28 leaving the primary separator(s) 30, from which a majority of the liquid has been removed, to remove as much of the remaining oil/liquid 29 from the wet gas 28 as possible.

Over 95 percent of the liquid in the wellhead fluids mixture 12 is separated therefrom by the primary separator (s) 30, and practically all of the remaining liquid in the wet gas 28 exiting the primary separator(s) 30 is removed by the secondary separators 50. Both the oil/liquid 26 removed by the primary separator 30 and the oil/liquid 29 removed by the secondary separator 50 are returned by gravity into a lower portion of the pressure vessel 14 forming a liquid inventory 31 therein. The high separation capacity of the primary and secondary separators 30, 50 allows for use of a single pair of primary and secondary separators if necessary, as shown in the embodiment of FIG. 3. As mentioned earlier, the single primary/single secondary separator arrangement would typically be sufficient to satisfy most subsea applications and thus facilitates design optimization and confirmation testing at prototypic conditions described in greater detail later.

Figure 5:
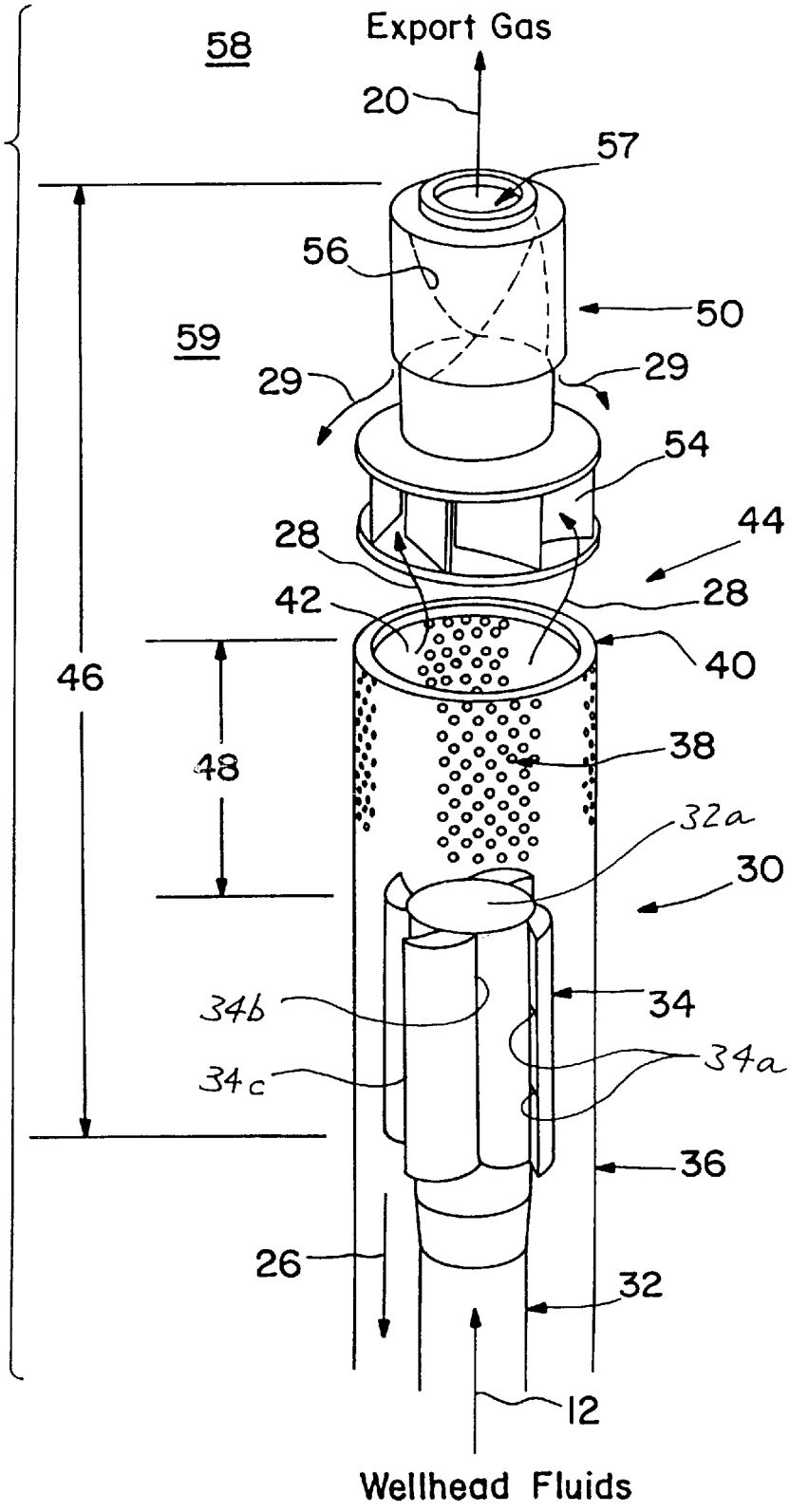
FIG. 5 is a close-up, perspective view of a curved-arm, primary separator and a cyclone, secondary separator according to the present invention.

As illustrated in FIGS. 1 and 5, each curved-arm, centrifugal force, primary separator 30 comprises a riser tube 32 for conveying the wellhead fluids mixture 12 upwardly therethrough, four sets of multilayered curved-arms 34, and an outer can or return cylinder 36 surrounding riser tube 32 and curved-arms 34. As indicated earlier, the curved-arms 34 of the primary separator(s) 30 need not be of the re-entrant type disclosed in the aforementioned U.S. Pat. No. 4,648,890; curved-arms 34 may also be just attached to the outside wall of riser tube 32.

Each multi-layered curved-arm 34 is formed of an axially extending curved wall which has an axially extending inner root edge **34*b* at the riser tube 32, and an axially extending outer edge 34*c*, the wall curving outwardly away from the riser tube. The riser tube has a closed upper end 32*a*. Radial partitions 34*a* divide the interior of the curved-arms 34** into their multiple layers.

The wellhead fluids mixture 12 enters at the bottom of the riser tube 32 and flows upwardly therethrough until reaching the vicinity of the curved-arms 34, where it exits the riser tube 32. The majority of the oil/liquid separation from the wellhead fluids mixture 12 occurs as the mixture 12 flows through the curved-arms 34, the denser oil/liquids 26 in the mixture 12 tending towards the outer walls of the curved-arms 34. During the centrifugal separation process, a film of oil/liquid 26 develops on the inner wall of the return cylinder 36 and cascades down to the main liquid inventory 31 FIG. 1). The return cylinder 36 extends above the top of the curved-arms 34 where there are a number of perforations 38, preferably ½ inch in diameter, and a retaining lip 40 at open top 42 of separator 30 which are used to improve the liquid removal capabilities of the separator 30 at high gas and liquid flows, and especially where slug conditions can exist. Various perforation geometries may be employed. The wet gas 28 exits the open top 42 of the primary separator(s) 30 into a substantially open interstage region 44 which is used to more evenly distribute the wet gas 28 prior to its entering the secondary cyclone(s) 50. This interstage region 44 also permits liquid droplets to fall out by gravity when wet gas flow 28 is below the droplet entrainment threshold. To ensure that the export gas 20 is as dry as possible, a required spacing distance indicated at reference numeral 46 in FIG. 5 is maintained between the primary separators 30 and the secondary separators 50, preferably at approximately 4 feet.

A separation distance is also maintained between the top of the multi-layered curved-arms 34 and the open top 42 of the primary separator 30, indicated at reference numeral 48, and preferably ranges from approximately 15 to approximately 18 inches. Liquid removal capacity can be increased by extending this distance.

As the two-phase wellhead fluid mixture 12 flows out through the curved-arms 34, separation occurs as the heavier oil/liquid droplets 26 migrate to the outer radius of the curved-arms 34 and the less dense wet gas 28 migrates to the inner radius of the curved-arms 34. Separation in the curved-arms 34 allows for an oil/liquid film 26 to be cleanly discharged onto the inner diameter of the return cylinder 36. The retaining lip 40 and perforations 38 are important at high wellhead fluids mixture 12 flows because the retaining lip 40 restricts the growth of the oil/liquid film 26 upwardly while the perforations 38 remove the separated oil/liquid 26 from the inside of the return cylinder 36 allowing it to return by gravity along the outside of return cylinder 36 to become a part of oil/liquid inventory 31. After flowing through the primary separator 30, the majority of separated oil/liquid 26 spirals downward on the inner diameter of the return cylinder 36 and combines with the liquid inventory 31 in the pressure vessel 14. The wet gas 28 and any remaining entrained oil/liquid droplets 29 enter the secondary separator 50 where the oil/liquid 29 is centrifugally separated from the wet gas 28. The separated oil/liquid 29 is returned to form a part of the liquid inventory 31 via drain tube 52 and the liquid-free vapor or export gas 20 exits the pressure vessel 14 as shown in FIG. 1.

The primary separator 30 has several advantages. The first is that the majority of the separation processes occur at the curved-arms 34. This makes the process inherently capable of accommodating a wide range of flow and level conditions and minimizes the potential for gas entrainment and resultant swelling in the pressure vessel 14's liquid inventory 31. Another advantage is that the relatively large flow passages of the curved-arms 34 essentially eliminates the risk of pluggage since there are no narrow gaps which could attract deposits. The result is a low-pressure drop, high performance primary separator 30 that will have a long life of maintenance-free service.

The secondary separator 50 also operates on the principle of centrifugal separation. The wet gas 28 enters the secondary separator 50 through tangential inlet vanes 54 at the bottom of the secondary separator 50 which impart a centrifugal motion to the wet gas 28. Any liquid remaining in the wet gas 28 is then forced to the inner wall of the secondary separator 50 where it is separated by secondary skimmer slots 56, exits through secondary outlet 57, and spills into secondary compartment 58 (FIG. 1). Secondary separator(s) 50 would typically be inserted through and supported by plate 60, to which would also be connected drain tubes 52. Bypass holes 62 are placed in top plate 64 of a tertiary compartment 59 to allow gas bypassing through the secondary skimmer slots 56 to exit the tertiary compartment 59 and enhance the skimming action. The separated oil/liquid 29 then drains via drain tube 52 back into lower portion of pressure vessel 14 and becomes a part of the main pressure vessel 14's liquid inventory 31. The drain tube 52 isolates the returning separated oil/liquid 29 from the upflowing wet gas flow 28 and avoids the re-entrainment of separated oil/liquid 29 by the upflowing wet gas 28.

The centrifugal force cyclone, secondary separator 50 has an inherent advantage over scrubber or mesh type dryers. Both scrubber and mesh type dryers are limited in flow capacity by the droplet entrainment threshold, beyond which liquid droplets are entrained with the vapor and are carried therewith. The centrifugal force cyclone, secondary separator 50, on the other hand, can efficiently operate at vapor fluxes typically two to three times higher than the droplet entrainment threshold.

FIG. 3 illustrates a second aspect or embodiment of the present invention which comprises a single pair, centrifugal, gas/oil separator apparatus generally designated 70, for subsea applications. In this embodiment, the pressure vessel 14 is supported and partially contained by a pipe or conduit 72 partially embedded within a seabed 74. The pressure vessel 14, as shown in FIG. 4, includes a radial, side wellhead fluid inlet 76 for providing the wellhead fluids 12 into the vessel 14 as well as an oil/liquid export outlet 78 for conveying separated oil or liquids 24 out of the pressure vessel 14 and a gas export outlet 80 for conveying separated gases 20 from the pressure vessel 14. The height between export gas outlet 80 and the top of the conduit 72 is indicated at reference numeral 82 and is preferably approximately 5 feet. The height of the return cylinder 36 is indicated at reference numeral 84 and is dependent on inventory and level control requirements.

Figure 6:
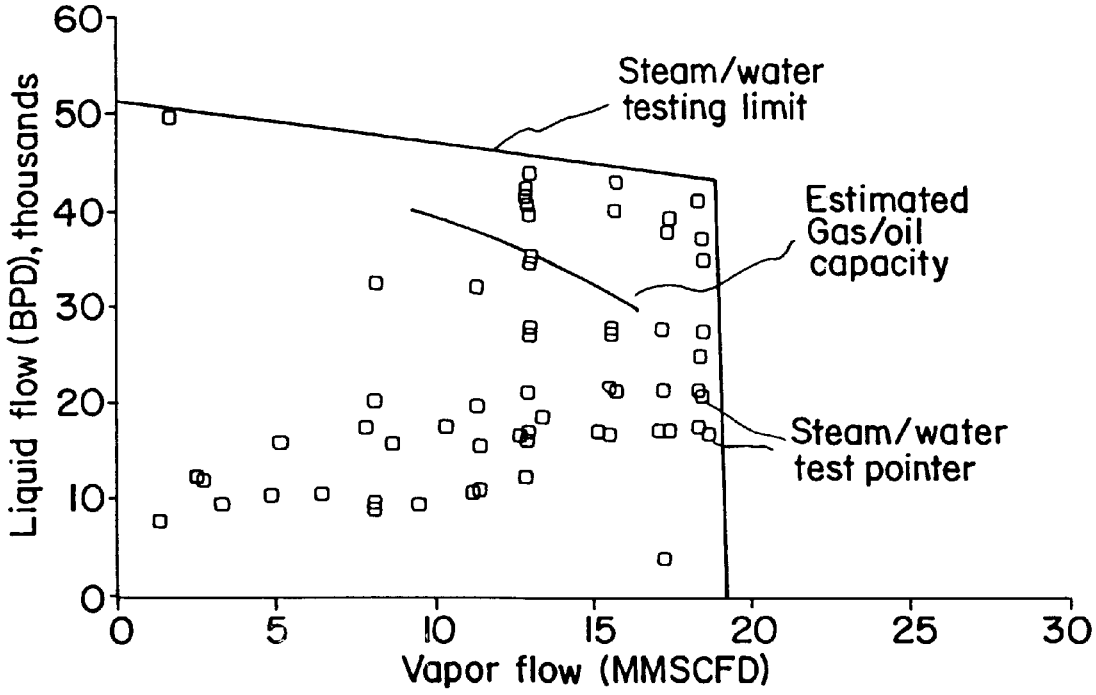
FIG. 6 is a graph plotting test results for liquid flow versus vapor flow in a centrifugal separator arrangement according to the present invention.

FIG. 6 illustrates the performance characteristics of a single-module centrifugal separator pair in a steam/water environment. The results from a steam/water test at 880 psia test pressure were used for conservatively estimating gas/oil separator performance. These estimates suggest that a single centrifugal separator pair (one primary and one secondary separator) can effectively separate over 43,000 barrels per day BPD) of oil and over 20 million standard cubic feet per day (20,000,000 SCFD or 20 MM SCFD) of gas for high pressure (approximately 1000 psia) applications and over 34,000 BPD oil and 15 MMSCFD gas for low pressure (approximately 250 psia) applications. The peak production for a typical water driven 10-well field is around 25,000 BPD and 14 MMSCFD.

The unique features of the present invention are noted and summarized below:

1. One unique feature of the present invention is the use of centrifugal-type separators for both the primary and secondary stages of separation. Other separator arrangements typically rely on gravity or inertial separation, which is limited in flow capacity by the droplet entrainment threshold beyond which liquid droplets are entrained with the vapor which are carried downstream. In contrast, the secondary separator of the present invention is a centrifugal-type separator which can efficiently operate at vapor fluxes significantly higher than the entrainment threshold.
2. The compactness of the present invention is also unique. The separation envelope needed for a single-module, centrifugal gas/oil separator arrangement is approximately 4 feet long by 2 feet in diameter. Additional drum or pressure vessel 14 volume may be required to satisfy other system parameters such as inventory demands and liquid level control requirements. A pump 86 for pumping separated liquids and a provision for removing sand 90 from the liquid inventory 31, such as a sand separator or pump schematically indicated at 88, may be incorporated into the gas/oil separator arrangement 70 for certain applications as shown in FIG. 3.
3. Another unique feature of the present invention is the manner in which the centrifugal forces are generated in the primary separator 30. The centrifugal force develops as the mixture turns 90° out of the riser tube 32 and flows out through the curved-arms 34. This feature allows the two-phase wellhead fluids mixture 12 to enter the pressure vessel 14 through either a lower axial inlet to the riser tube 32 FIG. 1) or through a side, radial inlet to riser tube 32 FIG. 3) providing design flexibility for introducing the wellhead fluids 12 into the gas/oil separator arrangements 10, 70. Other known separator designs used for gas/oil applications rely on a radial or tangential inlet into the primary separator to create the centrifugal forces.

The compact, high-efficiency, gas/oil separator arrangements 10, 70 of the present invention offer several advantages when compared to the known designs. These advantages include a high vapor capacity, a compact arrangement, and maintenance-free characteristics of the separation equipment.

Another advantage of the present invention is that the primary and secondary centrifugal separators 30, 50 have no moving parts and no small passages. This eliminates the potential for hardware pluggage and provides for reliable, long-term, maintenance-free operation, which is extremely beneficial for subsea gas/oil separation applications where accessing the equipment for unplanned maintenance has proven to be very costly.

The compactness of the present invention provides economical advantages because of the reduced capital to initially fabricate the unit and because of reduced space requirements and/or lifting capacity required to install the equipment topside or subsea.

While specific embodiments of the invention have been shown and described in detail to illustrate the application of the principles of the invention, it will be understood that the invention may be embodied otherwise without departing from such principles.

We claim:

1. An apparatus for separating an oil/liquid phase from a gas phase contained in a wellhead fluid from a hydrocarbon production system, comprising, in combination with the hydrocarbon production system:

a vessel having a wellhead fluid inlet connected to the hydrocarbon production system, for entry of wellhead fluid, a gas export outlet for exit of export gas separated from the wellhead fluid, and an oil/liquid export outlet for exit of oil/liquid separated from the wellhead fluid;

means in the vessel defining a main oil/liquid inventory compartment at a lower end of the vessel, the oil/liquid export outlet communicating with the inventory compartment, a secondary compartment at an upper end of the vessel, and means for connecting the inventory and secondary compartments to each other;

a primary centrifugal separator in the vessel for separating a majority of the oil/liquid phase from the wellhead fluid to leave a wet gas phase, the primary centrifugal separator comprising a riser tube with an open lower end communicating with the wellhead fluid inlet for receiving upwardly flowing wellhead fluid, the riser tube having a closed upper end, a plurality of curved-arms spaced around the riser tube for causing a majority of the oil/liquid phase to separate from the wellhead fluid to leave the wet gas phase, each curved-arm having an axially extending curved wall, curving away from the riser tube between a root edge of the curved wall at the riser tube and an outer edge of the curved wall spaced outwardly from the riser tube, at least one radial partition in the curved-arm, for dividing an inner space defined by the curved-arm into multiple levels, the primary centrifugal separator also comprising a return cylinder around the riser tube and curved-arms, for receiving oil/liquid phase moving outwardly by centrifugal force from the outer edge of the curved-arms, the return cylinder having an open lower end extending into the inventory compartment for carrying the oil/liquid phase downwardly to the inventory compartment, the return cylinder having an open upper end for passing the wet gas phase; and a secondary centrifugal separator in the vessel spaced above and axially aligned with the primary centrifugal separator by an open interstage region, the secondary centrifugal separator receiving the wet gas phase and comprising a plurality of tangential inlet vanes into which the wet gas phase passes for further separating oil/liquid from the wet gas phase to leave a dry gas phase, the secondary centrifugal separator including skimmer means defining skimmer slots above the inlet vanes for receiving the dry gas phase and for channelling the further separated oil/liquid downwardly into the secondary compartment, the further separated oil/liquid passing from the secondary compartment to the inventory compartment through the means for connecting the inventory and secondary compartments, the skimmer means having an open upper end communicating with the gas export outlet for passing the dry gas phase to the gas export outlet.

2. An apparatus according to claim 1 wherein the return cylinder includes a plurality of perforations therearound, above the riser tube.

3. An apparatus according to claim 2 wherein the open upper end of the return cylinder has a radially inwardly extending lip, the open upper end of the skimmer means also having a radially inwardly extending lip.

4. An apparatus according to claim 3 including a lower support plate extending across the vessel between the inlet vanes and the skimmer means, the support plate defining a lower boundary of the secondary compartment, the means for connecting the inventory and secondary compartments comprising a tube opening into the support plate and extending to the inventory compartment.

5. An apparatus according to claim 4 including a top plate spaced above the support plate and extending across the vessel above the skimmer means, the open upper end of the skimmer means extending through the top plate and at least one hole in the top plate for receiving any separated oil/liquid passing above the top plate, through the top plate for return to the inventory compartment.

6. An apparatus according to claim 5 wherein the oil/liquid export outlet extends through a side of the vessel at a lower end of the vessel which communicates with the main oil/liquid inventory compartment.

7. An apparatus according to claim 6 wherein a portion of the return cylinder which carries the perforations above the riser tube, is approximately 15–18 inches high.

8. An apparatus according to claim 7 wherein a distance between an upper end of the skimmer means and a lower end of the curved-arms, is approximately 4 feet.

* * * * *